US008636552B2

(12) United States Patent
Braden et al.

(10) Patent No.: US 8,636,552 B2
(45) Date of Patent: Jan. 28, 2014

(54) POWERED SURFBOARD

(75) Inventors: Paul T. Braden, Honolulu, HI (US); Sterling Higashi, Honolulu, HI (US)

(73) Assignee: Paul T. Braden, Honolulu, HI (US)

( * ) Notice: Subject to any disclaimer, the term of this patent is extended or adjusted under 35 U.S.C. 154(b) by 39 days.

(21) Appl. No.: 12/926,098

(22) Filed: Oct. 26, 2010

(65) Prior Publication Data

US 2011/0111650 A1 May 12, 2011

Related U.S. Application Data

(60) Provisional application No. 61/272,720, filed on Oct. 26, 2009.

(51) Int. Cl.

| | |
|---|---|
| ***B60L 11/00*** | (2006.01) |
| ***B63H 21/17*** | (2006.01) |
| *B63B 1/00* | (2006.01) |
| *B63B 35/00* | (2006.01) |
| *B63B 35/81* | (2006.01) |
| *A63C 5/03* | (2006.01) |

(52) U.S. Cl.
USPC ..... 440/6; 441/65; 441/74; 441/79

(58) Field of Classification Search
USPC ..... 441/65, 68, 74, 79; 114/55.5, 55.54, 114/55.56, 55.58; 440/1, 6, 49, 66, 71, 79, 440/82, 84, 87
See application file for complete search history.

(56) References Cited

U.S. PATENT DOCUMENTS

| | | | | |
|---|---|---|---|---|
| 3,405,677 | A * | 10/1968 | Smith | 114/55.53 |
| 3,456,613 | A * | 7/1969 | Smith | 440/6 |
| 3,536,025 | A * | 10/1970 | Tierney | 440/6 |
| 4,364,711 | A * | 12/1982 | Brandt et al. | 416/142 |
| 7,930,985 | B2 * | 4/2011 | Walworth et al. | 114/55.58 |
| 2003/0167991 | A1 * | 9/2003 | Namanny | 114/55.56 |
| 2004/0090195 | A1 * | 5/2004 | Motsenbocker | 318/109 |
| 2006/0148345 | A1 * | 7/2006 | Omohundro | 441/75 |

* cited by examiner

*Primary Examiner* — Daniel Venne
(74) *Attorney, Agent, or Firm* — Novak Druce Connolly Bove + Quigg LLP

(57) ABSTRACT

A surfboard has a surfboard body, an electric motor, and a propeller. An electric power circuit provides power to the electric motor from a source of electro-motive force within the interior of the surfboard body. Additional electrical components, which may be capacitor banks, limit the rate of acceleration of the surfboard body. Several different capacitor banks may be included to provide selectable rates of acceleration.

19 Claims, 6 Drawing Sheets

(a)

(b)

(c)

POWERED SURFBOARD

CROSS-REFERENCE TO RELATED APPLICATIONS

This application claims priority to U.S. Provisional Patent Application No. 61/272,720, entitled "Powered Surfboard," and filed Oct. 26, 2009, the disclosure of which is incorporated herein by reference in its entirety.

STATEMENT REGARDING FEDERALLY SPONSORED RESEARCH OR DEVELOPMENT

None.

NAMES OF THE PARTIES TO A JOINT RESEARCH AGREEMENT

None.

BACKGROUND

Surfboards are elongated platforms used in the sport of surfing. They are relatively light, but strong enough to support an individual standing on them while riding a breaking wave. According to the Wikipedia, (http://en.wikipedia.org/wiki/Surfboard), they were invented in Hawaii, where they were known as Papa he'e nalu in the Hawaiian language, usually made of wood from local trees, such as koa, and were often over 15 feet (5 m) in length and extremely heavy. Major advances over the years include the addition of one or more fins on the bottom rear of the board to improve directional stability, and numerous improvements in materials and shape. Modern surfboards are made of polyurethane or polystyrene foam covered with layers of fiberglass, cloth and polyester or epoxy resin. The end result is a light and strong surfboard that is buoyant and maneuverable. Recent developments in surfboard technology have included the use of carbon fiber. Most modern surfboards can be divided into two main categories: longboards and shortboards. Longboards, as the name suggests, are longer (often 8 ft/2.4 m or more), and are also thicker and wider, with a more rounded nose than a shortboard. Shortboards are shorter (5-7 ft/1.5-2.1 m), thinner, and have a more pointed nose. They are not as wide as longboards and are typically more maneuverable.

The surface of the board that rests on the water is called the "bottom." The surface of the board that the surfer stands on is called the "deck." The front tip of the board is the "nose." The rear tip of the board is the "tail." The edges of the board are "rails." The surfboard "fin" and "skegs" are stabilizing struts fixed to the bottom of the surfboard near the tail to prevent it from sliding sideways. A surfboard "leash" is a cord that attaches a surfboard to the surfer.

Stand up paddle surfing (SUP), or in the Hawaiian language Hoe he'e nalu, is an emerging global sport with a Hawaiian heritage. The sport is an ancient form of surfing, and began as a way for surfing instructors to manage large groups of learner surfers, as standing on the board gave them a higher viewpoint and increased visibility of what was going on around them—such as incoming swells. To begin with, this started with using a one-bladed paddle whilst standing on a normal length surfboard. Modern stand up paddle surf boards have been adapted from other boards by having greater displacement and deck surface.

Powered surfboards have been proposed in the past, but it is not believed that any electrically powered surfboard is commercially available as of June 2009.

SUMMARY

An objective of the invention is to provide an improved, powered surfboard. Further objects of the invention are:

1. to provide an electrically powered surfboard with improved acceleration characteristics;
2. to provide an electrically powered surfboard with selectable acceleration characteristics;
3. to provide an improved stand-up paddle surfboard;
4. to provide a powered surfboard with an improved human interface;
5. to provide a powered surfboard with improved environmental characteristics; and
6. to provide an improved surfboard with improved features for powered use.

These and other objectives are achieved by providing a surfboard with an electric motor, a propeller and a source of electromotive force (electricity), such as batteries. An electrical power circuit may include a remotely controlled switch to engage power to the motor, and one or more capacitor banks to limit acceleration of the surfboard. Several capacitor banks may be provided with a selector switch to allow different, selectable rates of acceleration. Alternately, a continuously-variable power controller may be provided, preferably with a wireless human interface. The propeller may fold to improve handling during non-powered operation and to reduce environmental impact. Cleats may be provided for towing. The surfboard body may be sized for stand-up paddle surfing.

BRIEF DESCRIPTION OF THE SEVERAL VIEWS OF THE DRAWING

Reference will be made to the following drawings, which illustrate preferred embodiments of the invention as contemplated by the inventor(s).

DETAILED DESCRIPTION OF THE INVENTION

Figure 1:
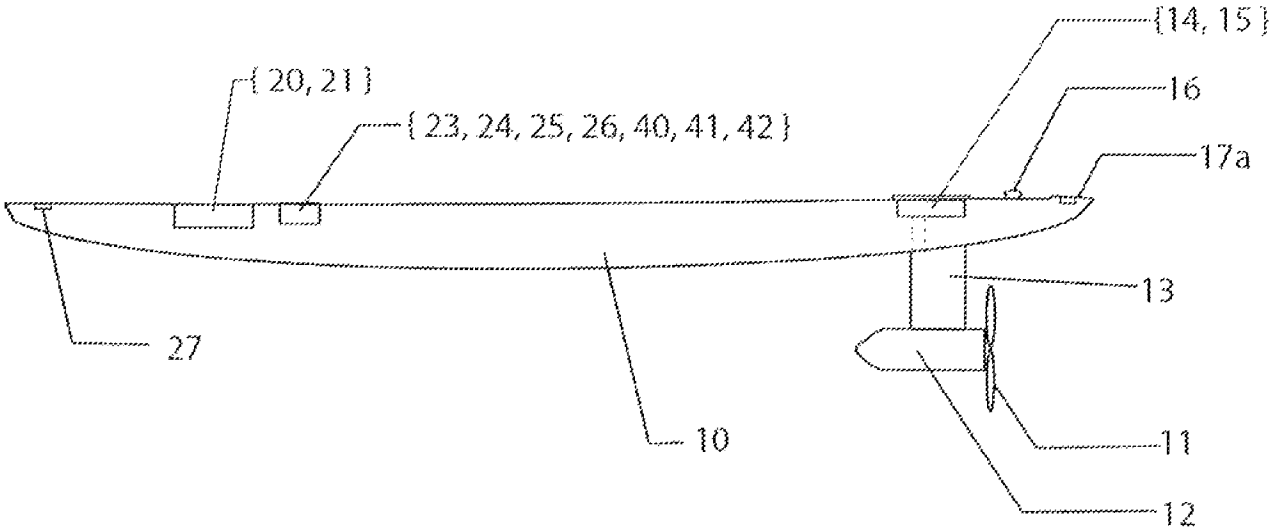
FIG. 1 is a side plan view of a novel powered surfboard.

FIG. 1 is a side plan view of a novel powered surfboard. The surfboard body 10 provides buoyancy for itself, its attachments, and at least one surfer. The surfboard body 10 may be made of any buoyant material. Preferred materials for the outer shell would be a polymer material such as polyester or epoxy. The shell interior preferably is filled with foam.

A propeller 11 powered by an electric motor 12 attaches to the bottom of the body 10 near the tail through a motor mount 13. When the motor 12 rotates the propeller 11, they provide thrust to the surfboard. When the motor 12 is not rotating the propeller 11, the propeller 11 preferably folds, which reduces drag when riding a wave and makes the surfboard more safe to other surfers and to the environment. Optionally, the surfboard may have a protective shroud over the propeller (as discussed further below). The folded configuration is especially useful (a) when riding a wave, (b) when the surfer is paddling, stroking or otherwise providing a motive force for moving the surfboard through the water, (c) when near other surfers, (d) when near vulnerable environments, and (e) when storing or transporting the surfboard out of the water. An electrical storage system provides power to the electric motor 12, as will be discussed more fully below.

An aft access portal 14 provides access to an internal compartment containing electrical wiring, connectors, any other service or utility items 15 associated with the electric motor 12, and other items located in the aft portion of the surfboard body 10 as desired. The aft access portal 14 preferably is waterproof, transparent and located on the deck of the surfboard body 10 toward the tail. An emergency shut down switch 16 operable by the surfer in the water preferably is mounted to the deck of the surfboard body 10 near the tail. An aft cleat 17*a* for fastening a line also may be provided on the deck of the surfboard body 10 near the tail. A line attached to the rear cleat has many potential uses, such as making fast (i.e., securing) the surfboard to another object (e.g., mooring to a boat or dock), for towing another watercraft (including another surfboard), or otherwise forming attachments between the surfboard and other objects.

Components of an electrical circuit for powering the motor, which may include batteries 20 and capacitors 21 as discussed further below, mount securely within the interior of the surfboard body 10, preferably near the nose. Batteries 20 preferably are rated for marine use with waterproof and explosion-proof casings. The batteries 20 and capacitors 21 may be enclosed in one or more waterproof casings within the interior of the surfboard body 10 as added protection in case the surfboard body 10 looses its integrity. The exact location may vary and/or be adjustable for surfboard balance. One or more forward access portals 22*a*, 22*b* (FIG. 2) provide(s) access to additional components, such as an electrical connector 23 for charging the batteries 20, fuses 24, additional electrical wiring, and any other items located in the forward section of the surfboard body 10. The forward access portals 22*a*, 22*b* preferably are waterproof, transparent, and located on the deck of the surfboard body 10 toward the nose. Additional items may include a "battery on" indicator light 25, which may be green, and a "propeller active" indicator light 26, which may be red. A forward cleat 27 for fastening a line also may be provided on the deck of the surfboard body 10 near the nose.

The surfboard may be provided with a wireless control for the electric motor 12 which would include a radio antenna 40, radio receiver 41, and relay or other switch 42, located within the surfboard body 10 and accessible through one or more forward access portals 22*a*, 22*b*. In such a configuration, a surfer would control the electric motor using a radio transmitter 43 preferably attached to his/her body through a wrist strap 44.

Figure 2:
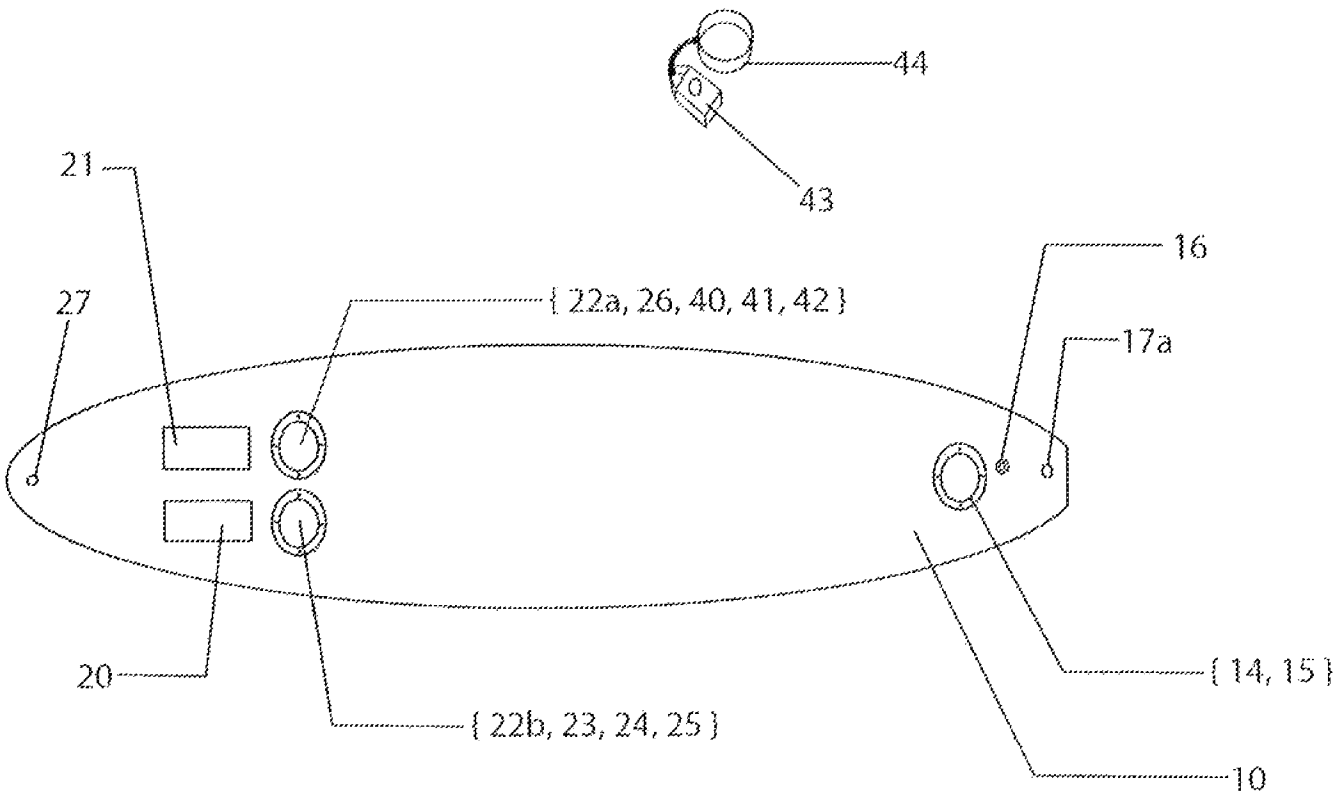
FIG. 2 is a top plan view of a novel powered surfboard.

FIG. 2 is a top plan view of a novel powered surfboard. Items shown by reference numeral in FIG. 2 are the same as identically-numbered items in FIG. 1. FIG. 2 illustrates batteries 20 and capacitors 21 located side-by-side relative the centerline of the surfboard body 10, however, other arrangements may be used. For example, the batteries 20 and capacitors 21 all may be placed along the centerline, with capacitors 21 located forward of the batteries 20, or vice versa. The batteries 20 and capacitors 21 may be fixedly encased within the surfboard body 10.

FIG. 2 illustrates two forward access portals 22*a*, 22*b* positioned to give access to items on the interior of the surfboard body that potentially require (or would benefit from) access, such as electrical components and connections. Exemplary components could include "battery on" indicator light 25 and a "propeller active" indicator light 26 positioned underneath a transparent access portal, however, indicator lights may be placed elsewhere on the surfboard body, or even with the radio transmitter 43. FIG. 2 illustrates two access portals 22*a*, 22*b* located side-by-side relative to the centerline of the surfboard body 10, however, other arrangements may be used.

Figure 3:
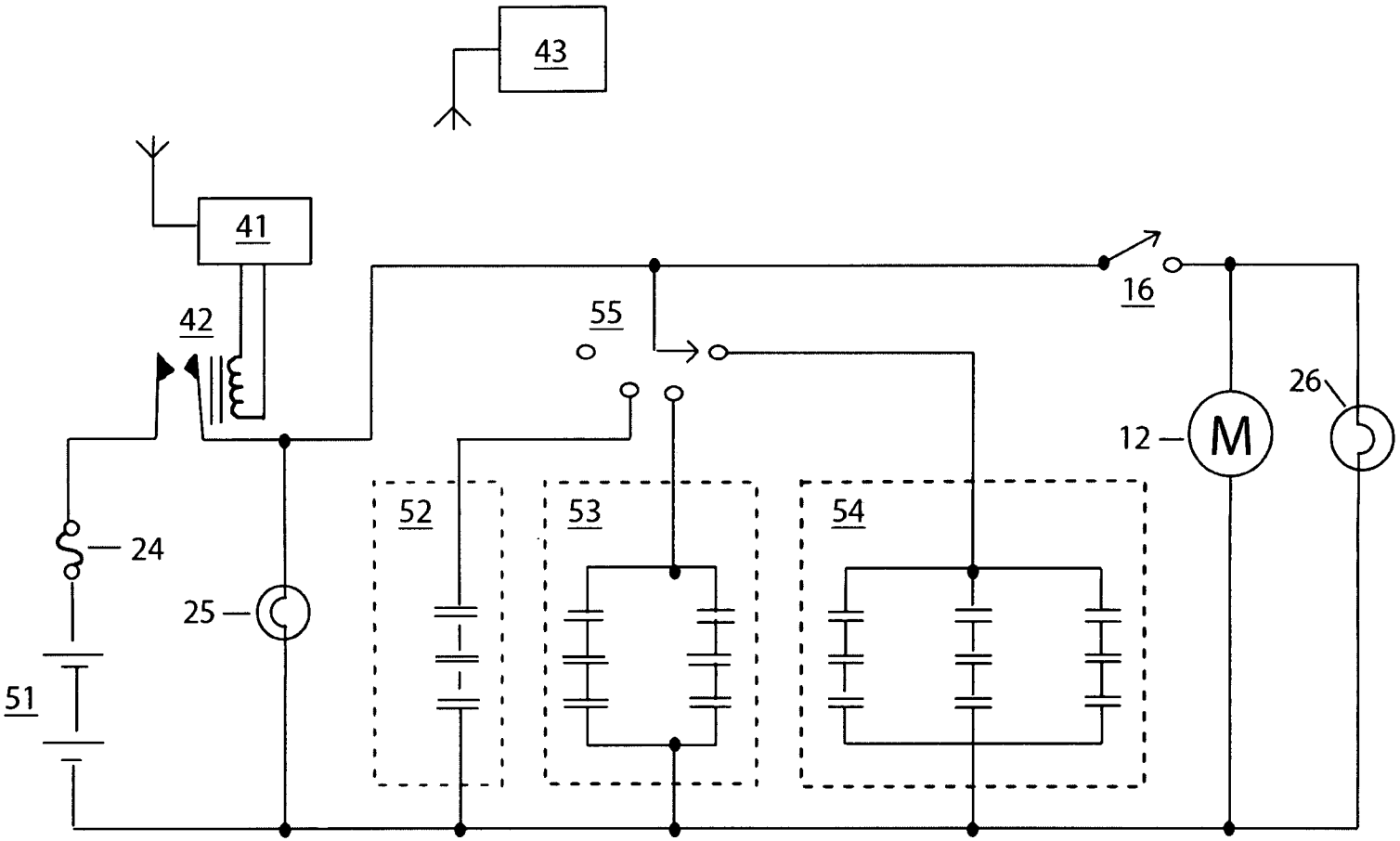
FIG. 3 is an electrical schematic diagram of a power circuit for a novel powered surfboard.

FIG. 3 is an electrical schematic diagram of a power circuit for a novel powered surfboard. A source of electrical power provides energy for electric motor 12 to turn the propeller 11 (FIG. 2). FIG. 3 illustrates two series-connected batteries 20 as the power source, though other configurations of batteries may be used, and other sources of electrical power may be used, including but not limited to other types of energy storage devices, fuel cells, or electricity generating devices not yet invented. For the example of FIG. 3, the positive terminal of batteries 20 connects through a safety fuse 24 to contacts of single-pole, single-throw relay 42. The relay contacts are connected so that, during nominal operation, closure of the contacts of the relay 42 connects the batteries 20 to a first terminal of a DC electric motor 12. A radio receiver 41 energizes or de-energizes the relay 42 according to commands received from radio transmitter 43. The radio receiver 41 may be powered by a dedicated battery. The motor-side contact of the relay 42 connects to emergency shutdown switch 16, which in turn connects the power circuit to a first terminal of the motor 12. The emergency shutdown switch 16 preferably is placed near the motor 12 to isolate the motor 12 when open. A "common" connection between the second terminal of the motor 12 and the negative terminal of the batteries 20 completes the electrical circuit. Exemplary batteries may be two, series connected lithium-ion battery packs with each pack having a rated voltage of 14.8 volts and a rated storage capacity of 20 amp-hours. (A battery pack may include four, series connected lithium-ion cells with each cell rated at 3.7 volts.) An exemplary motor may be a Minn Kota DC motor rated for 24 volts, such as a Minn Kota RT/80EM. Other batteries and motors may be used.

A "battery on" indictor light 25 connects to the power circuit at or near the motor side of the relay contacts and illuminates when the relay has engaged the batteries to the rest of the power circuit. The "battery on" indicator light 25 may, for example connect between the motor-side contact of the relay 42 and the common battery connection. A "propeller active" indicator light 26 connects to the circuit at or near the motor 12 and illuminates while the motor 12 is powered. The "propeller active" indicator light 25 may, for example, connect between the positive motor contact and the battery common connection. (As discussed above, the "battery on" and "propeller active" indicator lights may be positioned behind a transparent access portal where they can be seen by the surfer.)

Wireless control of relay 42 is the preferred method for engaging and disengaging power to the propeller during routine operation, however, other control mechanisms may be used. For example, the relay 42 may be controlled by a wired connection to a switch operated by a surfer, or the relay 42 could be replaced by a mechanical switch operated by a surfer. As yet a further variation, the on-off function of the relay 42 may be replaced by a continuously variable power controller under the command of a joystick or other variable interface device manipulated by the surfer. The variable interface device may have a wired or wireless connection to the variable power controller.

Closure of relay 42 may initiate a sudden inrush of current to the motor 12, which in turn may result in a sudden acceleration of the surfboard and which may cause a surfer to loose balance. Similarly, the sudden deceleration resulting from a sudden disengagement of the propeller also could cause a surfer to loose balance. Acceleration and deceleration can be reduced by engaging capacitors in parallel with the motor, which limits the rate of change of voltage and current reaching the motor. FIG. 3 illustrates an example of capacitive elements in the form of three banks of capacitors 52, 53, 54, each of different total capacity. Any of the three banks may be switched into the circuit using selector switch 55, which has its common pole connected to the positive side of the power circuit between the relay 41 and safety switch 16. Each capacitor bank connects between one selectable pole of the selector switch 55 and the battery common connection. A fourth selectable pole of selector switch 55 remains open. Selecting the open pole of selector switch 55 leaves all three capacitor banks disengaged, which in turn gives the greatest (e.g., a first) rate of acceleration and deceleration. Selecting the smallest capacity bank 52 results in a lesser (e.g., a second) rate of acceleration and deceleration. Selecting the middle capacity bank 53 results in yet a lesser (e.g., a third) rate of acceleration and deceleration. The largest capacity bank 54 has the greatest effect on the transient operation of the motor 12, that is, it causes the motor to have the lowest (e.g., a fourth) rate of acceleration and deceleration.

Each capacitor may be rated at 350 Farads. The smallest capacitor bank 52 may include a single set of three such capacitors in series. The intermediate capacitor bank 53 may include two sets of such capacitors connected in parallel, with each set being three capacitors in series. The largest capacitor bank 54 may include three sets of such capacitors in parallel, with each set being three capacitors in series. Each set of capacitors alternately may include one, two, or a differing number such capacitors connected in series, or capacitors of other values.

After the transient period of acceleration, the capacitors will be fully charged. Upon disengagement of the motor by opening relay 42, the capacitors continue to power the motor for a limited time until the motor depletes the stored charge, which slows the rate of deceleration. A surfer may disengage the capacitors before they have completely discharged by opening the safety switch 16 so that the motor 12 can be brought to a more rapid stop.

While FIG. 3 shows a four-pole selector switch with three separate capacitor banks, other connections may be used having differing numbers of banks, or causing more than one bank to become engaged at a time. Furthermore, it may be desirable to "hard wire" a single capacitor bank in parallel with the motor 12, with or without a capability for a user to selectively engage additional capacity values.

Figure 4:
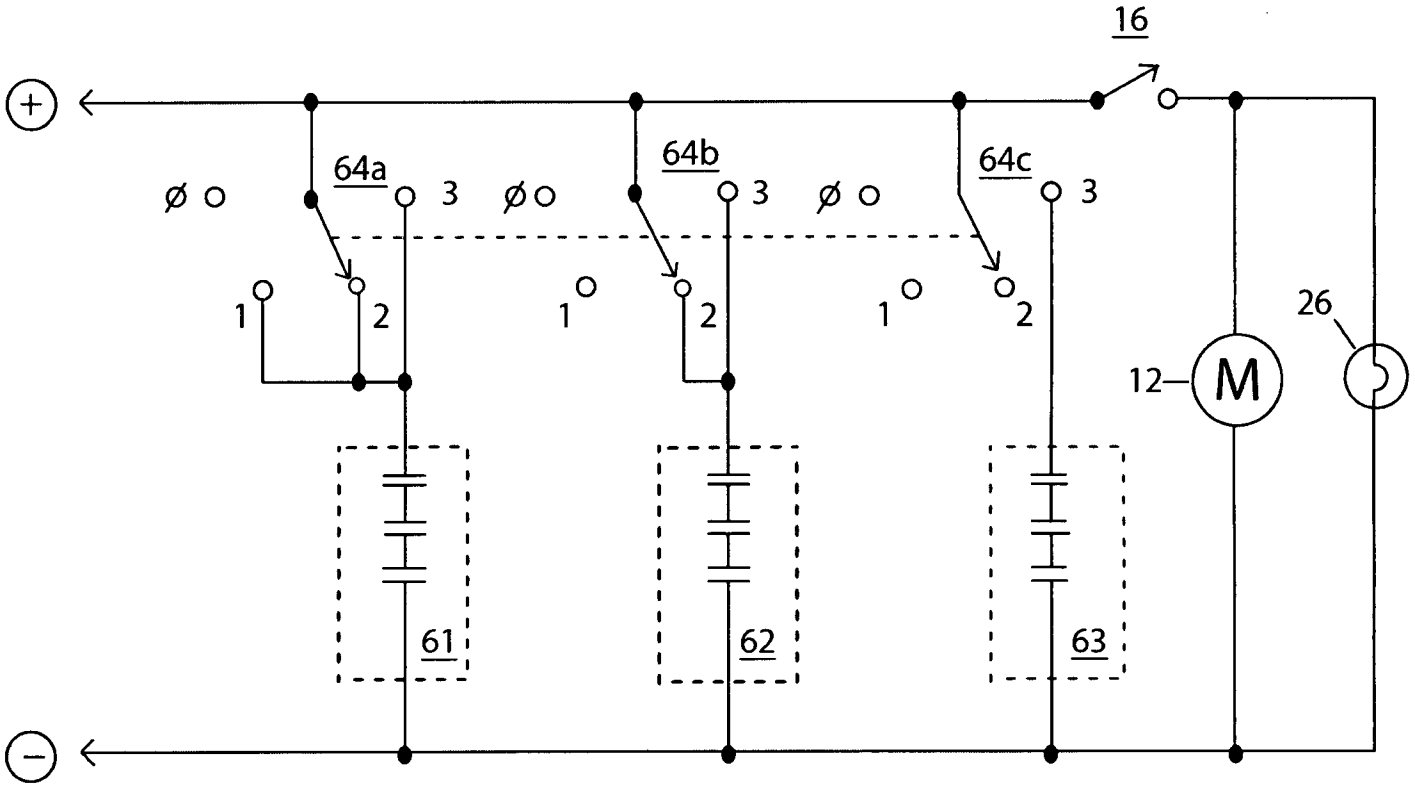
FIG. 4 is an electrical diagram of an alternate arrangement for capacitive elements of a novel powered surfboard.

FIG. 4 is an electrical diagram of an alternate arrangement for capacitive elements of a novel powered surfboard. This arrangement utilizes three sets of capacitive elements 61, 62, 63, with each set having three capacitors in series. A selector switch has three ganged stages 64*a*, 64*b*, 64*c* all turning together through four positions designated as "0", "1", "2" and "3". A first capacitive element 61 connects on a first stage 64*a* to poles for positions "1", "2", and "3". A second capacitive element 62 connects on a second stage 64*b* to poles for positions "2" and "3". A third capacitive element 64 connects to a third stage 64*c* to poles for position 3. The first pole "0" of all three stages 64*a*, 64*b*, 64*c* remains open. The common pole of all three stages 64*a*, 64*b*, 64*c* connects to the positive battery terminal (such as through relay and fuse not shown) and to the motor (such as through emergency shutdown switch 16). When the selector switch is set to position "0", all three capacitor banks 61, 62, 63 are isolated. In position "1", the selector switch connects a single capacitor bank 61 in parallel with the motor 12. In position "2", the selector switch connects two capacitor banks 61, 62 in parallel with the motor 12. In position "3", the selector switch connects all three capacitor banks in parallel with the motor 12. This arrangement allows for fewer total capacitors than the arrangement shown in FIG. 3. Other capacitor arrangements can be used.

Figure 5:
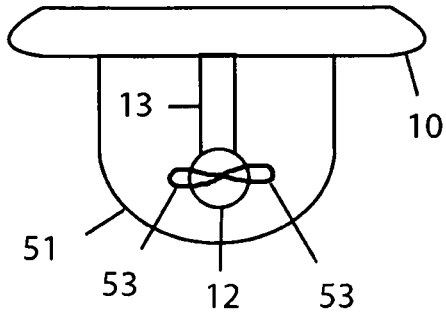
FIGS. 5*a*, 5*b* and 5*c* are rear and side views of a tail portion of a powered surfboard.
Figure 5:
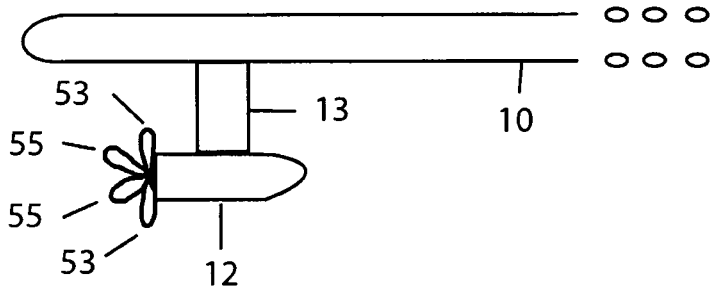
Figure 5:
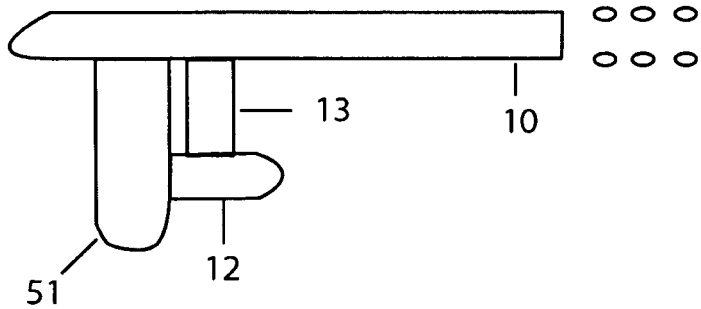

FIGS. 5*a*, 5*b* and 5*c* are rear and side views of a tail portion of a powered surfboard. These views illustrate some elements discussed previously, including surfboard body 10, motor 12, and motor mount 13.

FIG. 5*b* illustrates an optional folding propeller with two blades. In a first orientation, the propeller blades 53 are extended such that their long axes are substantially perpendicular to the long axis of the surfboard body 10. This is a orientation in which power from the motor rotates the blades 53 to produce thrust. In an alternate orientation, the blades 55 fold back so that their long axes are more closely aligned to parallel to the long axis of the surfboard body. The blades may, but need not fold back all the way to parallel. This is an unpowered orientation in which the blades 55 are not rotated by the motor 12 (though they may rotate under the influence of water passing over the blades 55). The folding may be accomplished passively by hinging the blades near the center of rotation. Centrifugal force of rotation will move the blades toward the perpendicular orientation when under power. When not under power, drag forces may fold the blades toward the parallel orientation, or the blades may be biased with a spring or other biasing force.

Figure 6:
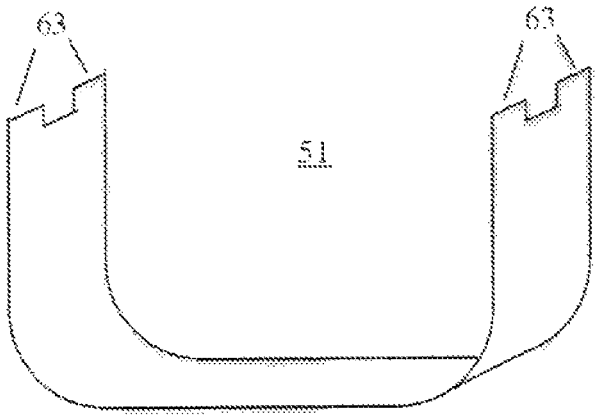
FIG. 6 is a perspective view of an optional protective shroud for a powered surf board.

FIGS. 5*a* and 5*c* illustrate an optional protective shroud 51. The shroud 51 mounts to the surfboard body 10 around the sides of the propeller 53 so as to prevent the propeller blades from striking objects laterally. FIG. 6 is a perspective view of an exemplary protective shroud 51. It may be formed of a composite material into a "C" shaped cross section or other contour. Notches 63 at the open ends of the "C" shape may be formed to insert into complementary holes in the bottom of the surfboard body 10 for attachment.

The embodiments described above are intended to be illustrative but not limiting. Various modifications may be made without departing from the scope of the invention. The breadth and scope of the invention should not be limited by the description above, but should be defined only in accordance with the following claims and their equivalents.

What is claimed is:

1. A surfboard comprising:

(A) a surfboard body having an interior and an exterior;

(B) an electric motor attached to the surfboard body;

(C) a propeller attached to the electric motor;

(D) an electric power circuit including (i) the electric motor, (ii) a switch, and (iii) a source of electro-motive force located within the interior of the surfboard body and capable of producing a first acceleration rate of the surfboard body when electrically connected to the motor by the switch; and (E) a first capacitive element connected to the electric power circuit to limit surfboard body acceleration to a second acceleration rate less than the first acceleration rate when the motor is connected to the source of electromotive force.

2. A surfboard as in claim 1 further including a second capacitive element connected to the electric power circuit to limit surfboard body acceleration to a third acceleration rate when the motor is connected with the source of electromotive force, said third acceleration rate being less than the second acceleration rate.

3. A surfboard as in claim 2 further including a third capacitive element connected to the electric power circuit to limit surfboard body acceleration to a fourth acceleration rate when the motor is connected with the source of electromotive force, said fourth acceleration rate being less than the third acceleration rate.

4. A surfboard as in claim 1 wherein the first capacitive element includes a plurality of capacitors.

5. A surfboard as in claim 2 further including a selector switch allowing a user to switch any of the first and second capacitive elements into the electric power circuit.

6. A surfboard as in claim 3 further including a selector switch allowing a user to switch any of the first, second and third capacitive elements into the electric power circuit.

7. A surfboard as in claim 1 further including a safety switch allowing a user to disengage the capacitive element.

8. A surfboard as in claim 2 further including a safety switch allowing a user to disengage the first and second capacitive elements.

9. A surfboard as in claim 3 further including a safety switch allowing a user to disengage the first, second and third capacitive elements.

10. A surfboard as in claim 1 further including a human interface displaying an indication that the source of electromotive force is connected to the electric power circuit.

11. A surfboard as in claim 1 further including a wireless human interface.

12. A surfboard as in claim 1 further including at least one cleat.

13. A surfboard as in claim 1 further including a shroud disposed proximately to the propeller so as to prevent lateral contact between the propeller and other objects.

14. A surfboard as in claim 1 wherein the surfboard is a stand up paddle surfboard.

15. A surfboard comprising:

(A) a surfboard body having an interior and an exterior;

(B) an electric motor attached to the surfboard body;

(C) a propeller attached to the electric motor;

(D) an electric power circuit including (i) the electric motor, (ii) a switch, and (iii) a source of electro-motive force located within the interior of the surfboard body and capable of producing a first acceleration rate of the surfboard body when electrically connected to the motor by the switch; and (E) a first capacitive circuit element connected to the electric power circuit to limit a rate of change of current to the motor.

16. A surfboard as in claim 15 wherein the first circuit element includes at least one capacitor.

17. A surfboard as in claim 15 wherein the first circuit element includes a plurality of capacitors.

18. A surfboard as in claim 15 further including:

(A) a second circuit element connected to the electric power circuit to limit the rate of change of current to the motor; and (B) a selector switch allowing a user to switch any of the first and second circuit elements into the electric power circuit.

19. A surfboard as in claim 18 further including a safety switch allowing a user to disengage the first and second circuit elements.

* * * * *